United States Patent [19]

Morimoto et al.

[11] Patent Number: 4,881,005

[45] Date of Patent: Nov. 14, 1989

[54] FLAT TYPE DISPLAY DEVICE

[75] Inventors: Kiyoshi Morimoto; Hiroshi Watanabe; Shigeo Itoh; Yukio Ogawa; Satoshi Uzawa, all of Mobara, Japan

[73] Assignee: Futaba Denshi Kogyo Kabushiki Kaisha, Mobara, Japan

[21] Appl. No.: 216,350

[22] Filed: Jul. 8, 1988

[30] Foreign Application Priority Data

Jul. 14, 1987 [JP] Japan ..... 62-176764

[51] Int. Cl.[4] ..... H01J 29/70

[52] U.S. Cl. ..... 313/422; 313/414

[58] Field of Search ..... 313/422, 411, 413, 414, 313/426, 427, 432, 436, 439; 315/366

[56] References Cited

U.S. PATENT DOCUMENTS 4,080,630 3/1978 Marlowe ..... 313/422 X 4,437,044 3/1984 Veith ..... 313/422 X 4,658,188 4/1987 Bohmer ..... 313/422 X

*Primary Examiner*—Kenneth Wieder

*Attorney, Agent, or Firm*—Oblon, Spivak, McClelland, Maier & Neustadt

[57] ABSTRACT

A flat type display device capable of being substantially thinned and carrying out display of very high definition on a large image plane. A plurality of electron streams emitted from a cathode arranged at one end of a airtight casing in a manner to be deviated from a phosphor screen section are guided and turned toward the phosphor screen section. Then, the electron streams are selected and controlled by an address electrode section, resulting in formation of an electron beam, which is then accelerated by an accelerating electrode section and impinged on the phosphor screen section for desired luminous display.

11 Claims, 3 Drawing Sheets

FLAT TYPE DISPLAY DEVICE

BACKGROUND OF THE INVENTION

1. Field of the Invention

This invention relates to a flat type display device for display of a picture image or a projected image, and more particularly to a flat type display device formed into a thin shape and adapted to carry out the display with high luminescence and definition.

2. Description of the Prior Art

In general, a display device employing a cathode ray tube (CRT) has been conventionally used for displaying a picture image or a projected image. Such a CRT-type display device is adapted to scan, on a phosphor-deposited screen, one or more electron beams generated from an electron gun and impinge electrons on a phosphor deposited screen at a high velocity. Accordingly, the conventional CRT-type display device exhibits the advantages of using high-velocity electron excited phosphor, carrying out colored display and accomplishing the display with high luminescence and definition.

However, the CRT-type display device is disadvantageous in that it is very hard to reduce a thickness of the CRT-type display device as well as its weight, because the electron gun must be arranged behind a display plane and it is required to increase its depth in order to scan electron beams between both ends of the screen.

Also, thin-type display devices have been developed and partially put to practical use which are adapted to display a picture image or a projected image in place of the CRT-type display device. Such thin-type display devices include a fluorescent display device, a liquid crystal display device, an electroluminescence display device, a plasma display device and the like.

Unfortunately, the thin-type display devices have the following important disadvantages. The fluorescent display device carries out colored display, however, the colored display lacks definition. Also, it fails to exhibit luminescence and life characteristics suitable for display of a picture image and a projected image, as well as cannot be large-sized to a degree sufficient to carry out the display. The electroluminescence display device and plasma display device each fail to provide colored display and exhibit satisfactory luminescence and life characteristics. The liquid crystal display device is of the non-emission type, so that it may not provide sufficient luminescence even when it is used in combination with a back light device. Also, the liquid crystal display device has a small angle of visibility, resulting in its display quality being substantially deteriorated. Thus, the liquid crystal display device likewise is insufficient to display a picture image and a projected image.

Further display devices are also proposed as disclosed in Japanese Patent Application Laying-Open Publication No. 48345/1983 and Japanese Patent Application Laying-Open Publication No. 171440/1984. The display devices each are adapted to use high-velocity electron excited phosphor.

More particularly, the display device taught in Japanese Patent Application Laying-Open Publication No. 48345/1983 includes a phosphor-deposited screen, an electron source including a plurality of filamentary cathodes arranged opposite to the screen and stretched in a horizontal direction with respect to the screen, and a control electrode group adapted to selectively draw out an electron beam from the cathodes and deflect it in a vertical or horizontal direction with respect to the screen. Luminous display is obtained by focusing electrons emitted from the cathodes into an electron beam and carrying out selection and deflection of the electron beam by means of the control electrode group, to thereby selectively impinge the electron beam on the screen.

The display device taught in Japanese Patent Application Laying-Open Publication No. 171440/1984 includes filamentary cathodes adapted to planely emit electrons, a screen having phosphor layers arranged in a stripe-like manner in a direction perpendicular to the filamentary cathodes, control electrodes for focusing the electrons into a beam-like shape and selectively forming the so-focused electrons into electron beams corresponding to the stripe-like phosphor layers, a deflection coil for deflecting the electron beams along the stripe-like phosphor layers, and a back electrode.

In the former display device or the device taught in Japanese Patent Application Laying-Open Publication No. 48345/1983, the filamentary cathodes are positioned opposite to the screen and electrons are impinged on the phosphor layers at a high velocity, resulting in phosphor deposited on an inner surface of the screen being decomposed. The so-decomposed phosphor then adheres to the filamentary cathodes to deteriorate electron emission capability of the filamentary cathodes, to thereby shorten a life of the device. Alternatively, oxide formed on a surface of each of the filamentary cathodes is decomposed and then adheres to the phosphor deposited on the screen to deteriorate emission efficiency of the phosphor, resulting the display device being short-lived.

Also, excessive deflection lines in vertical and horizontal directions render control of the electrons difficult and cause the diameter of the electron beam to be increased which leads to bleeding. Thus, it is not desirable to increase the number of deflection lines in a direction perpendicular to each filamentary cathode. Accordingly, it is required to increase the number of filamentary cathodes. However, this not only leads to an increase in power consumption but requires to carry out assembling of the display device with high accuracy because even slight misregistration of the filamentary cathodes with respect to other electrodes adversely affects display by the device, resulting in the assembling being highly troublesome. Further, in the display device, electron beams are formed directly from the filamentary cathodes, so that vibration of the filamentary cathodes leads to a variation of the electron beams. Unfortunately, this causes color shift and/or bleeding to occur in the display. Thus, the display device is not suitable for display on a large image plane in which long filamentary cathodes are required.

In the latter display device or the device taught in Japanese Patent Application Laying-Open Publication No. 171440/1984, the electron beams are deflected over a whole length of the stripe-like phosphor layers, resulting in the amount of deflection of the electron beams being increased. This renders uniform focusing of the electron beams over the whole length highly difficult. Also, deflection of the electron beams at a region adjacent to the display plane is carried out by a combination of the above-described back electrode and a mesh-like electrode or a phosphor electrode (final beam acceleration electrode). Accordingly there occurs a difference in angle of electron beams impinging on the phosphor between a portion of the screen far away from the electron source and a portion of the screen near the electron source. This causes electron beams impinging on the phosphor to be elongated particularly at the portion of the screen far away from the electron source although the electron beams are generally elongated in a direction perpendicular to the cathodes, resulting in a failure in a display with high definition.

SUMMARY OF THE INVENTION

The present invention has been made in view of the foregoing disadvantage of the prior art.

Accordingly, it is an object of the present invention to provide a flat type display device which is capable of being substantially thinned and carrying out display of very high definition on a large image plane.

In accordance with the present invention, a flat type display device is provided. The display device includes a box-like airtight casing in which electrodes are arranged and of which an interior is evacuated to high vacuum and a phosphor screen section having phosphor layers deposited thereon to form a display plane. Each of the phosphor layers is adapted to emit light due to impingement of an electron beam thereon. In the airtight casing is arranged an electron supply section so as to be positioned at an end of the airtight casing opposite to the display plane. The electron supply section includes an electron source for discharging electron streams in a direction parallel to the display plane and an electron flow guide for guiding the discharged electron streams and turning them toward the display plane at a predetermined position. Also, the display device includes an address electrode section for selecting and controlling a plurality of the electron streams drawn out from the electron supply section by means of at least horizontal and vertical selecting electrodes to form an electron beam and addressing a desired position on the display plane. Further, the device includes an accelerating electrode section for accelerating the electron beam formed in the address electrode section to impinge it on the phosphor screen section.

In the present invention constructed as described above, even when electrons are emitted at a relatively low velocity from the electron source, the electron flow guide guides the electrons toward the other end of the casing, resulting in the electron supply section being formed into a substantially plane shape. Kinetic energy of the electrons is limited to a low level in the electron flow guide, so that the electrons may be readily turned toward the phosphor screen section. Also, the electrons are selected and controlled by the address electrode section, resulting in formation of an electron beam, which is then accelerated by the accelerating electrode section and impinged on the phosphor screen section for desired luminous display.

BRIEF DESCRIPTION OF THE DRAWINGS

These and other objects and many of the attendant advantages of the present invention will be readily appreciated as the same becomes better understood by reference to the following detailed description when considered in connection with the accompanying drawings in which like reference numerals designate like or corresponding parts throughout; wherein.

DESCRIPTION OF THE PREFERRED EMBODIMENT

Now, a flat type display device according to the present invention will be described hereinafter with reference to the accompanying drawings.

Figure 1:
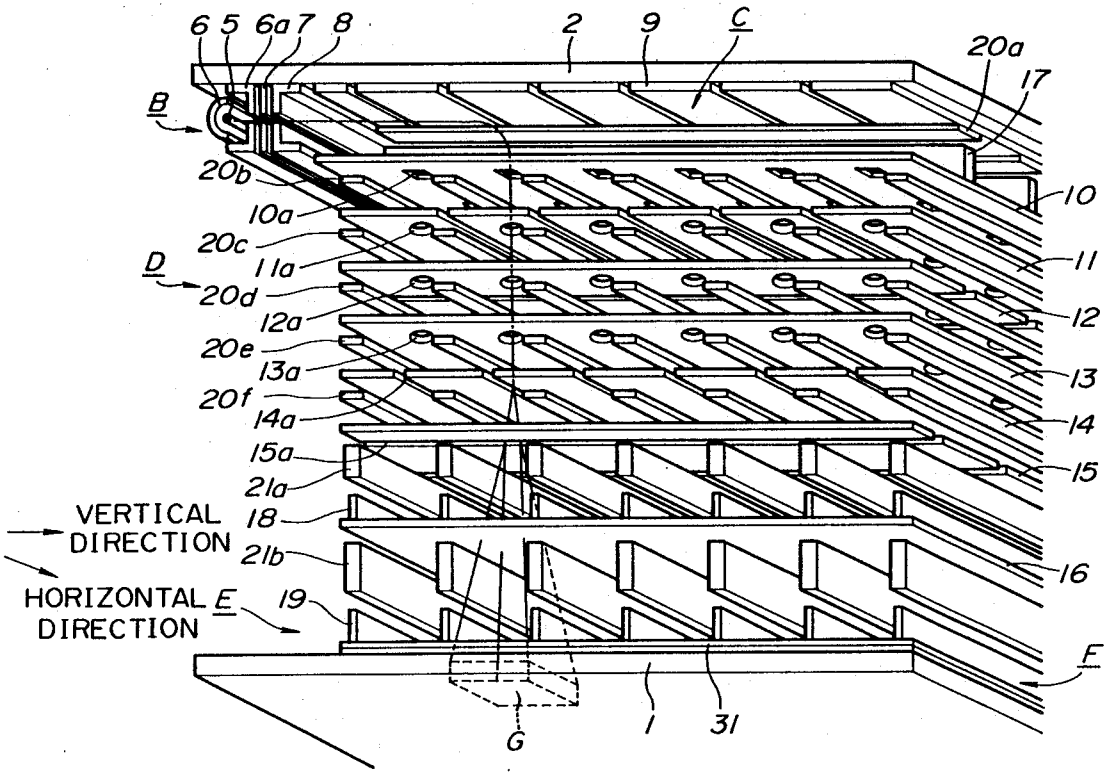
FIG. 1 is an exploded perspective view showing an essential part of an embodiment of a flat type display device according to the present invention.
Figure 2:
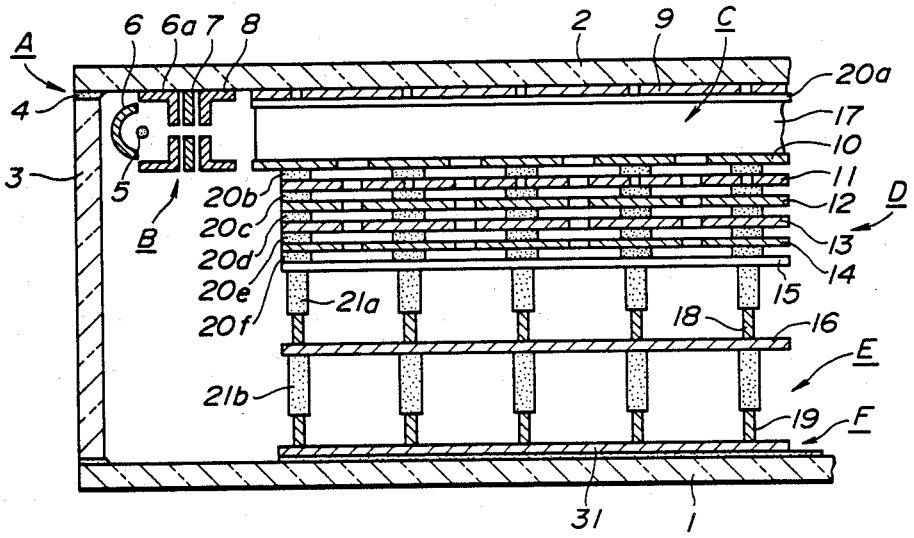
FIG. 2 is a cross sectional view of the flat type display device shown in FIG. 1.
Figure 3:
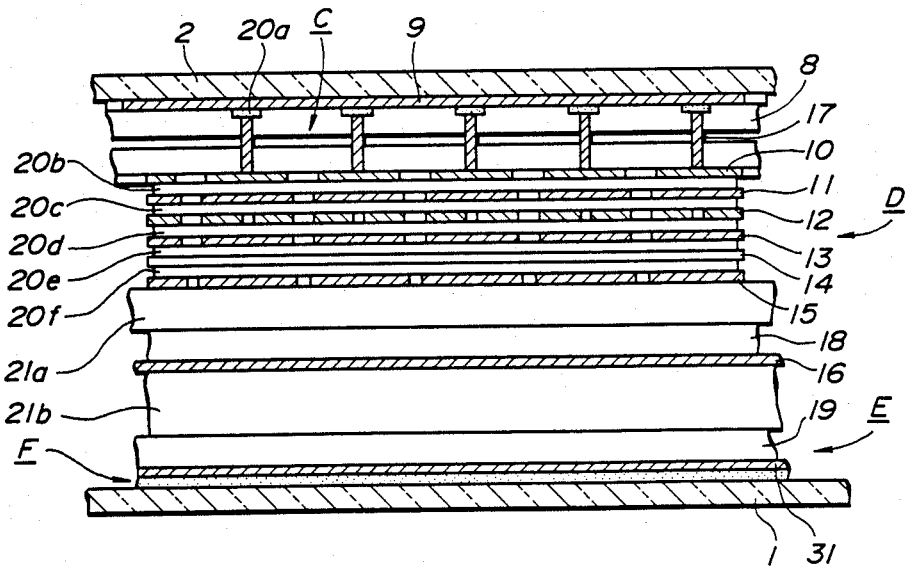
FIG. 3 is a vertical sectional view of the flat type display device shown in FIG. 1.
Figure 4:
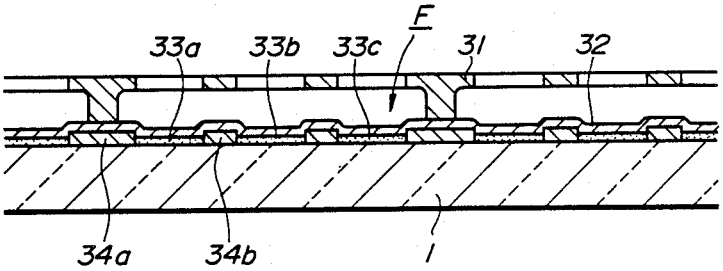
FIG. 4 is an enlarged sectional view showing a phosphor-deposited screen.

FIGS. 1 to 4 illustrate an embodiment of a flat type display device according to the present invention, wherein FIG. 1 is an exploded perspective view showing an essential part of an embodiment of a flat type display device according to the present invention, FIG. 2 is a cross sectional view of the flat type display device shown in FIG. 1, FIG. 3 is a vertical sectional view of the flat type display device shown in FIG. 1 and FIG. 4 is an enlarged sectional view showing a phosphor-deposited screen.

As shown in FIGS. 1 to 4, a flat type display device of the illustrated embodiment includes an airtight casing A into which a front cover 1 made of a light-permeable insulating material such as glass or the like, and a rear plate 2 and side plates each made of an insulating material such as glass are hermetically assembled by means of a sealing material 4 and of which an interior is evacuated to high vacuum. In the so-assembled casing A, an electron source B which includes an indirectly-heated filamentary cathode 5, a reflecting electrode 6, a control electrode 6*a*, a drawing-out electrode 7 and a focusing electrode 8 is arranged at an end of the casing A and near an inner surface of the rear plate 2. More particularly, the filamentary cathode 5 is stretchedly arranged along the end of the casing A and the reflection electrode 6 is formed into a semi-circular shape and adapted to focus electrons emitted from the cathode 5 toward a position opposite thereto. The control electrode 6*a* is provided at a central portion thereof with a ladder-like or slit-like opening and serves to control electron streams emitted from the cathode 5. The drawing-out electrode 7 is provided with an opening in a manner to be aligned with the opening of the control electrode 6*a* and serves to draw out electrons through the opening over a whole length of the opening. The focusing electrode 8 is adapted to focus electrons drawn out by the drawing-out electrode 7 and discharge them therefrom while accelerating them.

Also, the display device includes a plurality of back electrodes 9 arranged on the inner surface of the rear plate 2 in a manner to be separate from each other in a direction substantially parallel to the electron source B. At a position opposite to the back electrode 9 in the casing A is arranged a guide plate 10 through insulating spacers 20*a* and supports 17. At least a surface of each of the supports 17 is conductive. The so-arranged guide plate 10 forms an electron flow guide C in cooperation with the back electrode 9. The guide plate 10 is formed with a plurality of through-holes 10*a* in correspondence to an array of the separated back electrodes and display sections G, through which electron streams are transported in a direction of a phosphor screen section F. The supports 17 and spacers 20*a* are regularly arranged between the through-holes 10*a* in a direction perpendicular to the direction of the cathode 5, resulting in carrying a part of atmospheric pressure applied between the front cover 1 and the rear plate 2 in cooperation with spacers described below.

On a side of the guide plate 10 facing the phosphor screen section F are laminatedly arranged vertical selecting electrodes 11, horizontal selecting electrodes 12, a focusing electrode 13, vertical deflecting electrodes 14 and horizontal deflecting electrodes 15 through spacers 20b–20f in turn to form an address electrode section D. The vertical selecting electrodes 11 each are arranged so as to extend in a direction parallel to the direction of stretching of the cathode 5 and formed with through-holes 11a in a row at portions thereof positionally corresponding to the through-holes 10a of the guide plate 10. The horizontal selecting electrodes 12 are arranged so as to extend in a direction perpendicular to the vertical selecting electrodes 11 and formed with a plurality of through-holes 12a in a manner to positionally correspond to the through-holes 11a. Vertical and horizontal positions of the phosphor screen section F are selected by the vertical selecting electrodes 11 and horizontal selecting electrodes 12, respectively, so that one display section G displayed by a single electron beam may be selected.

The focusing electrode 13 comprises a single electrode plate formed with a plurality of through-holes 13a at portions thereof positionally corresponding to the through-holes 10a, 11a and 12a and is adapted to focus electrons selected by the vertical selecting electrodes 11 and horizontal selecting electrodes 12 into a beam-like shape.

The vertical deflecting electrodes 14 comprise a plurality of flat plates arranged so as to extend in the direction of stretching of the cathode 5 and separate from each other through slits 14a. The slits 14a each are arranged at a position through which an electron beam pass. The horizontal deflecting electrodes 15 comprise a plurality of flat plates arranged so as to extend in a direction perpendicular to the direction of stretching of the cathode 5 and separate from each other through slits 15a arranged at positions through which electron beams pass. Between the respective adjacent two vertical deflecting electrodes 14 or horizontal deflecting electrodes 15 are applied different deflecting voltages, so that electron beams are scanned while being deflected in a vertical or horizontal direction within the respective display sections G to excite desired picture cells and phosphor layers, to thereby obtain desired display.

Between the address electrode section D and the phosphor screen section F is formed an accelerating electrode section E. The accelerating electrode section E comprises insulating supports 21a, conductive supports 18, a protective electrode 16 electrically connected to the supports 18 and formed with meshy or lattice-like openings, insulating supports 21b, supports 19 and an anode plate 31 which are arranged in a manner to be laminated in order and positionally correspond to the spacers 20f. The supports 18 and 19 each are so formed that at least a surface thereof is conductive.

Now, the phosphor screen section F and anode plate 31 will be described in detail hereinafter.

The phosphor screen section F, as enlargedly shown in FIG. 4, includes a plurality of mask layers 34a and 34b different in size arranged on an inner surface of the front cover 1 so as to extend in a direction perpendicular to the cathode 5. The mask layers may be formed by screen printing or the like. Between the so-arranged mask layers 34a and 34b are deposited a phosphor layer 33a of blue luminous color, a phosphor layer 33b of red luminous color, a phosphor layer 33c of green luminous color each formed into a stripe-like shape. The mask layers 34a and 34b and the phosphor layers 33a, 33b and 33c each are provided on an inner surface thereof with a metal back layer 32. The metal back layer 32 may be formed by depositing an Al film on the inner surface by vacuum deposition or the like. The anode plate 31 is made of a metal material and provided with a plurality of openings in a regular manner by etching or the like. The openings are arranged in a manner to positionally correspond to the stripe-like phosphor layers 33a–33c and each are adapted to define one picture cell. The anode plate 31 is abutted on one surface thereof with the conductive supports 19 and formed on the other surface thereof with projections in a manner to positionally correspond to the mask layers 34a, through which the anode plate 31 is abutted against the metal back layer 32. The supports 19 are arranged in a direction substantially perpendicular to the stripe-like phosphor layers 33a–33c.

Thus, between the front cover 1 and the rear plate 2 are arranged various kinds of electrodes constituting the electron flow guide C, address electrode section D, accelerating electrode section E and phosphor screen section F, which are laminated through the spacers in order. The so-stacked electrodes and spacers carry atmospheric pressure applied to the front cover 1 and rear plate 2.

Now the manner of operation of the flat-type display device described above will be described hereinafter.

First, in the electron source B, voltage of a predetermined level is applied to the cathode 5 to heat it, so that a plurality of electron streams may be emitted therefrom, and to the reflecting electrode 6 is applied voltage of, for example, 0 to 30 V to direct the electron streams toward the electron flow guide C. To the control electrode 6a is applied voltage of, for example, −10 to 10 V to control the electron streams emitted from the cathode. Also, to the drawing-out electrode 7 is applied voltage of, for example, 20 to 100 V, so that the drawing-out electrode 7 draws out the electron streams through its slit-like opening over a whole length of the cathode 5 in cooperation with the control electrode 6a. To the focusing electrode 8 is applied voltage of 20 to 100 V depending on a size of a display region, so that it eliminates unnecessary electron streams of the electron streams drawn out by the drawing-out electrode 7 and accelerate necessary electron streams to introduce them into the electron flow guide C while keeping the electrode streams at a predetermined width. To the guide plate 10 which constitutes a part of the electron flow guide C is constantly applied voltage of about 50 to 100 V, and the back electrodes 9 and guide plate 10 are kept at substantially the same potential to guide the electron streams introduced from the electron source thereto toward the other end thereof. Then, when voltage of 0 to −100 V is applied to the back electrodes 9 in order from end to end, the strip-like electron streams in the electron flow guide C are turned toward the address electrode section D, resulting in being directed to the guide plate 10. This causes the electron streams to pass through the through-holes 10a of the guide plate 10. To the vertical selecting electrodes 11 is applied vertical selecting voltage of a predetermined level in order based on a predetermined frame frequency, resulting in scanning being carried out. As described above, the through-holes 10a of the guide plate 10 and the through-holes 11a of the vertical selecting electrodes 11 are arranged in a manner to positionally correspond to each other, therefore, electron streams which have passed through the through-holes 10a of the guide plate 10 then pass through the through-holes 11a of the vertical selecting electrodes 11 to which positive selecting voltage is applied by scanning. However, when positive voltage is not applied to the vertical selecting electrodes 11, the electron streams fail to pass through the through-holes 11a even if they pass through the through-holes 10a. Accordingly, even when the electron streams in the electron flow guide C are wide, they are formed into a shape precisely corresponding to picture cells on a display plane and the stripe-like phosphors when passing through the vertical selecting electrodes 11.

Then, to the horizontal selecting electrodes 12 is applied horizontal selecting voltage corresponding to a digital signal (pulse width modulation) or analog signal based on a luminescence signal and a color signal modulated from an image signal. The through-holes 12a of the horizontal selecting electrodes 12 are arranged so as to positionally correspond to the through-holes 11a of the vertical selecting electrodes 11, so that when positive voltage is applied to the horizontal selecting electrodes 12, the electron streams which passed through the through-holes 11a of the vertical selecting electrodes 11 pass through the through-holes 12a of the horizontal selecting electrodes 12. The electron streams thus selected by the vertical and horizontal selecting electrodes 11 and 12 are focused by the focusing electrode 13 while being accelerated, resulting in a single electron beam.

To the vertical deflecting electrodes 14 is applied voltage of several hundred volts, and deflecting voltages different from each other are applied between the respective adjacent vertical deflecting electrodes 14. For example, when deflecting eight picture cells in a vertical direction, deflecting voltage of eight steps is applied therebetween. This causes a vertical position in one display section G to be selected. To the horizontal deflecting electrodes 15 is applied voltage of several hundred volts, and deflecting voltages different from each other are applied between the respective adjacent horizontal deflecting electrodes 15 while deflecting voltage of one step is being applied to the vertical deflecting electrodes 14, resulting in a horizontal position in the one display section G being selected. For example, when deflecting one picture cell in a horizontal direction, deflecting voltage of three steps is applied therebetween for selecting the phosphor layers 33a to 33c; whereas when deflecting two picture cells, deflecting voltage of six steps is applied.

To the supports 18 and protective electrode 16 is applied voltage of about 300 to 500 V to accelerate the electron beam, as well as prevent other electrodes from being damaged due to discharge which possibly occurs between the protective electrode 16 and the phosphor screen section F. Further, to the supports 19, anode plate 31 and metal back layer 32 is applied voltage of 3 to 15 kV to selectively impinge the electron beam on the phosphor layers 33a to 33c at a high velocity, resulting in desired display.

As described above, the flat type display device of the illustrated embodiment is so constructed that the cathode 5 is arranged in a manner to be horizontally deviated with respect to the phosphor screen section F. Such construction, even when electrons impinge on an inner surface of the phosphor screen section F at a high velocity to cause decomposition and scattering of phosphor deposited on the screen, effectively prevents the decomposed phosphor from adhering to the cathode 5, resulting in preventing deterioration of electron emitting capability of the cathode. Also, the construction, even when oxide formed on a surface of the cathode 5 is vaporized, prevents the vaporized oxide from being deposited on the inner surface of the phosphor screen section F, so that deterioration of luminous efficiency of the phosphor layers 33a to 33c may be positively prevented. Further, the display device merely requires one such cathode 5. Even when the display region is formed into a large size, it requires at most several such cathodes. Thus, the display device significantly decreases its power consumption and facilitates assembling operation because the number of cathodes to be incorporated is less. Furthermore, electrons emitted from the cathode 5 are discharged from the electron source B at a relatively low velocity and in a relatively wide state and guided by the electron flow guide C constituted by the back electrodes 9 and guide plate 10, resulting in a substantially plane electron supply section being formed. The electrons are then turned toward the phosphor screen section F depending on scanning by the back electrodes 9 and gradually forms an electron beam while passing through the guide plate 10, vertical selecting electrodes 11, horizontal selecting electrodes 12 and the like. Accordingly, even when the cathode 5 is arranged at a position somewhat deviated from its normal position or vibrated, the electron beam formed is not substantially affected by such deviation or vibration of the cathode, resulting in satisfactory display free of bleeding and color shift. In addition, each one display section G displayed by each one electron beam may be small-sized as required without being affected due to mounting of the cathode 5 and the like, resulting in a scanning width of the electron beam being reduced.

Also, the supports 19 are arranged in the direction perpendicular to the stripe-like phosphor layers 33a to 33c; accordingly, even when the supports 19 each are relatively somewhat deviated along the stripe-like phosphor layers, such deviation does not affect display. Also, even when the electrodes including the supports 19 are relatively somewhat deviated in a direction perpendicular to the stripe-like phosphor layers, such deviation may be readily corrected by means of deflecting voltage applied to the vertical deflecting electrodes 15, accordingly, alignment between the respective electrodes and the phosphor screen section F may be relatively roughly carried out. Thus, the display device facilitates the alignment.

Assembling of the electrodes is accurately carried out by forming each of the electron source B, electron flow guide C, address electrode section D, accelerating electrode section E and phosphor screen section F in advance and then assembling them together by means of an assembling jig.

The electron beam is deflected in a region of relatively low voltage of several hundred volts, so that the deflection may be readily and accurately accomplished.

In the above-described embodiment, as the cathode 5 is used an indirectly heated filamentary cathode which does not produce a potential difference between both ends. However, when the flat type display device is small-sized, a directly heated filamentary cathode may be used as the cathode 5 so long as it does not significantly produce a potential difference between both ends. Also, a plane cathode of the indirectly heated type or the like may be substituted for the filamentary cathode. Configuration of the electrodes constituting the electron source such as the focusing electrode and the like, the number of such electrodes, voltage applied to such electrodes, and the like may be optimumly selected depending on configuration of the display device. In addition, in the embodiment described above, the vertical selecting electrodes and horizontal selecting electrodes constituting a part of the address electrode section each may be formed at a central portion thereof with a slit-like opening extending in a longitudinal direction thereof for the purpose of carrying out positional selection in vertical and horizontal directions. In the embodiment, the vertical deflecting electrodes and horizontal deflecting electrodes are provided. However, when a pitch between picture cells is large, the amount of deflection may be decreased. Alternatively, at least one of both deflecting electrodes may be eliminated. In the flat type display device shown in FIGS. 1 to 4, when it is desired to increase the amount of deflection, the vertical deflecting electrodes 14 each may be arranged on a side surface of the supports 21*a*. Furthermore, when the supports 21*a* and 18 are arranged in a direction parallel to the horizontal deflecting electrodes 15, the horizontal deflecting electrodes 15 each may be arranged on a side surface of the support 21*a*.

Figure 5:
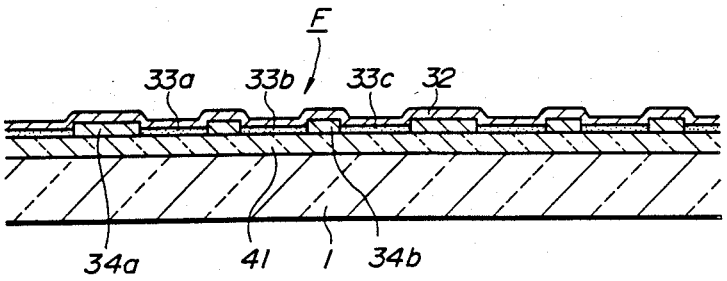
FIG. 5 is an enlarged sectional view showing a modification of the phosphor-deposited screen shown in FIG. 4.

In the above-described embodiment, the phosphor screen section F is formed directly on the inner surface of the front cover 1 constituting a part of the airtight casing A. However, it may be formed on a light-permeable plate 41 provided separate from the front cover 1, as shown in FIG. 5. Such construction permits the electrodes to be received in the airtight casing A while being aligned together and assembled in the form of a single unit, resulting in assembling of the display device being accomplished with high precision. Also, the anode plate 31 is not essential to the present invention, accordingly, it may be eliminated as shown in FIG. 5. In this instance, the conductive supports 19 and metal back layer 32 are directly contacted with each other. The embodiment is adapted to carry our colored display, however, it may be directed to monochromatic display. In this instance, the phosphor layers are arranged in a stripe-like manner between the mask layers. Alternatively, it may be so constructed that the mask layers are eliminated and the phosphor layers are formed directly on the front cover or light-permeable plate.

As can be seen from the foregoing, the flat type display device of the present invention includes the airtight casing, the phosphor screen section having the phosphor layers deposited thereon which are adapted to emit light due to impingement of an electron beam thereon and constituting the display plane, the electron supply section arranged at the end of the airtight casing opposite to the display plane and including the electron source for emitting electrons in a direction parallel to the display plane and the electron flow guide for guiding the emitted electrons and turning them toward the display plane at the predetermined position, the address electrode section for selecting and controlling a plurality of electron streams drawn out from the electron supply section by means of the horizontal and vertical selecting electrodes to form an electron beam and addressing a desired position on the display plane, and the accelerating electrode section for accelerating the electron beam formed in the address electrode section to impinge it on the phosphor screen section.

Thus, in the present invention, the electrode source is arranged in a manner to be laterally deviated with respect to the phosphor screen section. Such arrangement, even when phosphor deposited on the phosphor screen section is decomposed due to impingement of electrons on the phosphor screen section at a high velocity, effectively prevents the decomposed phosphor from adhering to the cathode of the electron source, resulting in ensuring satisfactory electron discharge capability of the cathode. Further, the arrangement, even when oxide formed on the surface of the cathode is vaporized, prevents the vaporized oxide from adhering to the inner surface of the phosphor screen section, so that deterioration of light emitting efficiency of the phosphor layers may be prevented.

Further, in the present invention, the electron streams drawn out from the electron sources over the whole length of the electrode source are guided by the electron flow guide while being kept at a predetermined width, resulting in the electron supply section being substantially plane. The so-guided electron streams are formed into an electron beam while passing through the electrodes in the address electrode section. Thus, the present invention is not constructed so that the cathode directly produces the electron beam; accordingly, even when the cathode is arranged at a position somewhat deviated from its normal position, its electrical correction may be readily carried out. Also this prevents vibration of the cathode possibly occurring when a filamentary cathode is used as the cathode from adversely affecting the electron beam, resulting in display with high definition and free of bleeding and color shift.

While a preferred embodiment of the invention have been described with a certain degree of particularity with reference to the drawings, obvious modifications and variations are possible in the light of the above teachings. It is therefore to be understood that within the scope of the appended claims, the invention may be practiced otherwise than as specifically described.

What is claimed is:

1. A flat type display device comprising:

a box-like airtight casing in which electrodes are arranged and of which an interior is evacuated to high vacuum;

a phosphor screen section having phosphor layers deposited thereon to form a display plane; said phosphor layers each emitting light due to impingement of an electron beam thereon;

an electron supply section arranged in said airtight casing so as to be positioned at an end of said airtight casing opposite to said display plane and including an electron source for discharging electron streams in a direction parallel to said display plane and an electron flow guide for guiding said discharged electron streams and turning them toward said display plane at a predetermined position;

an address electrode section for selecting and controlling a plurality of said electron streams drawn out from said electron supply section by means of at least horizontal and vertical selecting electrodes to form an electron beam and addressing a desired position on said display plane; and an accelerating electrode section for accelerating said electron beam formed at said address electrode section to impinge it on said phosphor screen section.

2. A flat type display device as defined in claim 1, wherein said electron source includes at least a cathode arranged so as to extend along the end of said airtight casing, a drawing-out electrode arranged in front of said cathode and formed at a central portion thereof with a slit-like, a ladder-like or meshy opening for drawing out electron streams over a whole length thereof, and a focusing electrode for focusing electron streams drawn out from said drawing-out electrode or eliminating unnecessary electron streams.

3. A flat type display device as defined in claim 1, wherein said electron flow guide is arranged on or adjacent to an inner surface of said airtight casing and includes a plurality of back electrodes arranged separate from one another in a direction parallel to a direction of arrangement of said electrode source, application of predetermined voltage to said back electrodes causing said electron streams to be deflected toward said address electrode section.

4. A flat type display device as defined in claim 1, wherein said address electrode section includes deflecting electrodes for deflecting said electron beam formed by said vertical and horizontal selecting electrodes in at least one of horizontal and vertical directions with respect to said display plane.

5. A flat type display device as defined in claim 1 or 4, wherein said address electrode section includes a focusing electrode arranged between said vertical or horizontal selecting electrodes and said deflecting electrodes.

6. A flat type display device as defined in claim 1, wherein said electrodes are laminatedly arranged through supports in said airtight casing.

7. A flat type display device as defined in claim 1, wherein said phosphor layers of said phosphor screen section have the same luminous color or different luminous colors and are arranged in a stripe-like and regular manner.

8. A flat type display device as defined in claim 1 or 7 further comprising an anode plate arranged on said phosphor screen section and formed with openings at every array of said phosphor layers or at every combination of arrays of said phosphor layers formed at the time of luminous display.

9. A flat type display device as defined in claim 1, wherein said accelerating electrode section is provided with a protective electrode.

10. A flat type display device as defined in any one of claims 1, 6 and 7, wherein accelerating electrode section constitutes a part of said supports and is arranged so as to extend in a direction perpendicular to said stripe-like phosphors.

11. A flat type display device as defined in any one of claims 1 or 7, wherein said phosphor screen section is formed directly on an inner surface of said airtight casing.

* * * * *